US005495138A

United States Patent [19]

Behr et al.

[11] Patent Number: 5,495,138

[45] Date of Patent: Feb. 27, 1996

[54] SINGLE-BASED ELECTRIC LAMP BASE STRUCTURE WITH CONNECTING LEAD STRAIN RELIEF

[75] Inventors: Gerhard Behr, Altheim; Peter Helbig, Sontheim; Hermann Steiner, Herbrechtingen, all of Germany

[73] Assignee: Patent-Treuhand-Gesellschaft F. Elektrische Gluehlampen mbH, Munich, Germany

[21] Appl. No.: 302,350

[22] Filed: Sep. 7, 1994

[30] Foreign Application Priority Data

Sep. 13, 1993 [DE] Germany ..... 9313823 U

[51] Int. Cl.[6] ..... H01J 5/48; F21M 7/00

[52] U.S. Cl. ..... 313/318.01; 313/318.1; 313/318.09; 439/611

[58] Field of Search ..... 313/318.01, 318.02, 313/318.03, 318.05, 318.06, 318.07, 318.09, 318.1, 318.11; 439/611, 612, 613, 614, 619

[56] References Cited

U.S. PATENT DOCUMENTS 4,795,939 1/1989 Eckhardt et al. .
5,270,610 12/1993 Schoenherr et al. .
5,291,092 3/1994 Coushaine ..... 313/318.01

FOREIGN PATENT DOCUMENTS 0172779 2/1986 European Pat. Off. .
0567925 11/1993 European Pat. Off. .
4037964C2 6/1992 Germany .
445864 5/1936 United Kingdom .

*Primary Examiner*—Donald J. Yusko
*Assistant Examiner*—N. D. Patel
*Attorney, Agent, or Firm*—Frishauf, Holtz, Goodman, Langer & Chick

[57] ABSTRACT

To provide a strain relief in a base for an electric lamp, adapted for connection to an external electrical energy source by at least one connection cable (6*a*, 6*b*) extending through and into the base, the base (2) is formed with a strain relief arrangement which includes a resilient sleeve (11) having an inner wall surrounding the at least one connection cable and, within the base bottom portion (9, 9'), a sleeve reception structure (9*a*) positioned inwardly of the bottom of the base, which includes a sleeve reception bore (10*a*, 10*b*) receiving and surrounding the resilient sleeve (11*a*, 11*b*) and exerting circumferentially uniformly, radially inwardly directed forces on the resilient sleeve. This decreases the diameter of the sleeve so that the inner wall thereof engages, clamps and squeezes the deformable insulation of the at least one connection cable and, also, can interengage or interlock therewith. The bottom portion (9) and the top portion (7) of the base are snapped together. The sleeve (11), preferably, is made of plastic, and made circumferentially resilient by forming one or more axial slits, for example in pairs, extending from opposite ends of the sleeve, so that, upon compression for example due to conical surfaces of the sleeve (11) and/or the bore (10), the sleeve will be essentially circumferentially uniformly reduced in diameter and engage on or into the insulation jacket (12) of the connecting cable (6).

22 Claims, 7 Drawing Sheets

SINGLE-BASED ELECTRIC LAMP BASE STRUCTURE WITH CONNECTING LEAD STRAIN RELIEF

Reference to related patents and application, the disclosures of which are hereby incorporated by reference, assigned to the assignee of the present application:

U.S. Pat. No. 4,795,939, Eckhardt et al

U.S. Pat. No. 5,270,610, Schönherr et al

U.S. Ser. No. 08/078,430, filed Jun. 16, 1993, Wittig et al, now U.S. Pat. No. 5,428,261, issued Jun. 21, 1995.

Reference to related publication:

German DE 40 37 964 C2, Albrecht.

1. Field of the Invention

The present invention relates to electric lamps, and more particularly to an electric lamp in which a bulb, retaining a light emitting arrangement, is retained in a base through which at least one insulated cable extends.

2. Background

When cables extend from the base of a lamp, it is desirable that the cable is securely retained in the base and that a strain relief arrangement is provided for the cable, engaging an insulation jacket thereof which surrounds one or more internal conductors. If external forces are applied to the connecting cable, it is necessary that the strain relief is sufficiently strong to prevent damage to connections between the connecting cable and current supply leads extending from the lamp bulb. International Standard ISO 8092-2, for example, requires for an externally extending cable having a cross-sectional area of the inner conductor of 0.75 $mm^2$, a minimum strain relief of 70N.

German DE 40 37 964, Albrecht, describes a strain relief which is formed by a clamping wedge located in a recess of the base, positioned transversely between two connecting cables, and which is pressed into the base. The clamping wedge has longitudinal ribs which dig into the insulation jacket of the connecting cables.

It has been found that the connecting cables are stressed only on one side by the clamping wedge which, during assembly, results in undesirable movement of the cable, and particularly in undesirable rotation, torsion or twist thereof. If the strain relief should be strong, it is necessary to so construct the longitudinal ribs that the insulation jackets of the connecting cables are highly squeezed or pinched, so that the longitudinal ribs engage into the insulation jacket. This increases the danger of damage to the inner conductor of the connecting cable by the longitudinal ribs of the clamping portion.

THE INVENTION

It is an object to provide a strain relief for cables integrated into the base of an electric lamp, which has high strain resisting capability, without damage to the conductors being relieved with respect to externally generated stresses. The strain relief should, preferably, also be suitable for rough service, that is, lamps subject to vibration, shock and the like, which may occur in installations in automotive vehicles, so that the cables can, for example, be directly connected to the electrical wiring under the hood of a car or truck.

Briefly, the strain-relieving arrangement, in accordance with the invention, is formed by a resilient sleeve surrounding the respective conductor, which is to be protected against external stresses. A sleeve reception structure is located in the bottom portion of the base, inwardly of the end thereof, which includes a sleeve reception bore receiving the respective resilient sleeve and exerting radially inwardly directed forces, circumferentially, on the resilient sleeve. This decreases the effective diameter of the resilient sleeve so that the inner wall of the resilient sleeve clampingly engages and squeezes the deformable insulation cover of the respective connecting cable. The bottom portion of the base, which can be separate from a top portion receiving the bulb, can be snap-connected, so that the bottom and top of the base are coupled together.

In accordance with a feature of the invention, the sleeve can be formed with a projection to interengage with the resilient insulation cover of the wire.

The basic concept of the invention, therefore, provides a strain relief within the base which exerts essentially uniform forces over the entire circumference of the connecting cable. Forces are generated which, essentially, are radially directed on the deformable insulation cover, which surrounds an inner conductor of the cable. These forces are essentially rotation-symmetrically applied on the insulation jacket. This avoids local maxima in the force distribution, and thus effectively eliminates the danger of damage of the inner conductor of the cable with equal stress applied to the cable, in comparison to non-uniform force application structures. Additionally, no movement or shifting of the connecting cable occurs during assembly of the cable, caused by tension and rotary forces which might cause damage of the connection between the cable and a current supply lead extending from the lamp bulb.

The structure has the additional advantage that neither the spatial arrangement of the cable, nor the number of the cables which can be placed into the base, is subject to limitations; each cable, in a two-conductor base, can be formed with its own strain relief arrangement.

In accordance with a feature of the invention, the resilient sleeve which is fitted on the insulation jacket of the attachment cable has a normal or base diameter or, respectively, circumference which, upon insertion into the base, is so decreased upon assembly of the cable in the base that the inner wall of the sleeve engages the insulation jacket of the connecting cable and squeezes or clamps the cable thereby. The arrangement can be made in such a manner that the sleeve only deforms the insulation jacket; alternatively, the sleeve can be so made that it partially engages within the insulation jacket itself, to form an interengaging fit. In either case, a combination of clamping or force engagement and deformation interengagement is obtained, permitting high stresses to be accepted. The stress resistance can readily be designed for particular stress values by suitable selection of the shape of the inner wall of the sleeve, by the characteristics of the materials of the insulation jacket and of the sleeve, respectively, and especially by the modulus of elasticity and shearing resistance of the materials of the insulation jacket and of the sleeve, respectively.

In accordance with a particularly preferred embodiment, the inner wall of the sleeve is essentially rotation-symmetrical, which provides for excellent coupling with the sleeve by surface frictional engagement. Circular cylindrical surfaces are suitable, formed for example with at least one ring-shaped constriction which provides a particularly high clamping or squeezing force. The constriction can be located at one or both ends of the sleeves, or at any position between the ends. To facilitate threading the sleeve over the connecting cable, such a constriction is preferably located by some distance from that end of the sleeve which is placed first over the connecting cable. Normally, this would place the constriction in the vicinity of that end of the sleeve which is located away from the tension direction. Thus, upon application of tension, the end of the sleeve will dig into the insulation jacket, so that the interengaging fit at that position is additionally reinforced, resulting in acceptance of high tension forces without, however, damage to the interior conductor since the compressive forces acting on the conductor are applied essentially circumferentially uniformly, which the conductor can readily resist.

One suitable shape for the inner wall of the sleeve is a constriction in form of a circumferential inwardly projecting ridge shaped, for example, similarly to a projecting cam or rounded rib. Two or more of such ring-shaped constrictions are also suitable, for example a rotation-symmetrical concave surface, or a periodic structure of projections and recesses or grooves, which may have sawtooth-shaped profiles. These need not necessarily be rotation-symmetrical. A particularly high stress resistance is obtained when the constricting structure is positioned perpendicularly to the direction of the stress vector, that is, essentially in azimuth direction. Axial rather than circumferential direction of the structure results in a sleeve which has lesser tension stress resistance than transversely to the central axis of the cable, with equal characteristics and materials of the sleeve and the insulation jacket of the cable. Basically, and depending on the selected profile, the material of the sleeve, and the material of the insulation jacket, the engagement between the sleeve and the insulation jacket depends on a deformation of the insulation jacket and/or of a penetration of a projecting element from the sleeve thereinto.

Reduction of the diameter of the sleeve, before assembly, by the interengagement with the base structure is obtained, in the simplest manner, by forming the sleeve with a slit, extending essentially parallel to the longitudinal axis, or not deviating substantially therefrom. The maximum possible reduction of the circumference is then essentially given by the width of the slit and the resiliency of the sleeve material. The maximum constriction is obtained when the two longitudinal edges of the sleeve, which define the slit, engage each other. If the inner wall of the sleeve is circular cylindrical, an essentially circumferentially uniform, cylindrical squeezing of the insulation jacket is obtained. Overlap of two edges is undesired, since this results in a localized, that is clearly not rotation-symmetrical clamping of the insulation jacket. Making the slit too wide, however, is also not acceptable because it results, again, by a substantial deviation from a cylinder with circular symmetry of the inner wall engaging the insulation jacket and, as a consequence, rotation-symmetrical force distribution is no longer obtained. A suitable width for the slit is approximately 10–15% of the circumference of the sleeve, before compression. It is not necessary that the edges of the slit are parallel to each other, that is, the width of the slit, in principle, need not be constant throughout the length of the sleeve. If, for example, a conical reduction of the circumference of the sleeve is intended, the slit can taper in the direction of the corresponding end of the sleeve.

A particularly good resilient effect, surprisingly, can be obtained by forming a plurality of slits in the sleeve, which, then, do not extend end-for-end, or at most one slit can extend all the way through. This, then, distributes the desired decrease of the diameter of the sleeve on a plurality of slits, and results in decrease of the necessary springy or resilient deflection path for each slit. The slits can be so made and arranged that the reduction about the circumference is either uniform over the entire length or non-uniform over the length, for example conical, or only over a portion of the length.

A uniform distribution over the entire length can be obtained, for example, when slits which terminate before reaching the opposite end of the sleeve extend from opposite sides or ends of the sleeve, and extend over substantially more than half the length of the sleeve. A specific combination of two such slits, which can be defined as counterdirected slits, is obtained, similar to one single through-slit, since the circumference of the sleeve can be decreased essentially uniformly approximately over its entire length. The uniformity is improved by making the slits longer than half the length of the sleeve, and the longer the sleeves extend towards the other, unslit end, the better the uniformity of force distribution on the insulation jacket. This, however, means that the remaining end portions of the sleeve at the ends of the slits become very narrow. A suitable compromise between mechanical strength of the sleeve and deformability can be readily determined by a few experiments. If the slits extend only to about the middle of the sleeve, or are shorter, then only the ends of the sleeves will be compressed; the central region of the wall of the sleeve will, necessarily, retain its original circumference.

In accordance with a particularly preferred embodiment, a plurality of counterdirected pairs of slits are used, rather than a single through-slit. Distributing a plurality of such counterdirected pairs of slits about the circumference of the sleeve permits uniform distribution of the reduction of circumference over the entire wall, better than with a single slit, and retention of the original circular cylindrical base of the inner wall of the sleeve.

While it is possible to distribute the slits non-symmetrically about the circumference of the sleeve, this is a less desirable alternative since reduction in the circumference results in a somewhat greater deviation from the original circular cylindrical basic shape of the inner wall of the sleeve.

The sleeve above described can also be used for the mode in which the reduction of the circumference is non-uniform with respect to its length, for example, conical, or affecting only a portion of the length of the sleeve. The sleeves above described can be used for such arrangements, by merely so dimensioning and shaping the sleeves that the radial forces needed for reduction of the circumference do not act uniformly along the length of the sleeve. For example, slits of counterdirected pairs can have different lengths. It is also not necessary to place counterdirected slits in pairs but, rather, start different numbers of slits from the respective opposite ends. To obtain a conical decrease of the diameter, it is sufficient if the sleeve is formed with slits only at the end which is to become conically compressed. Sleeves constructed this way are particularly easy to manufacture and, thus, costs can be saved. If the conical taper generated by the radially inwardly directed forces is directed counter the direction of stress, a particularly good resistance against tension is obtained because a tight engagement with the insulation jacket of the cable will result. This arrangement also permits use of sleeves which have smooth inner walls, and are devoid of ribs or internal projections which, further, decreases manufacturing costs.

An auxiliary element is used to decrease the original circumference of the sleeve. The auxiliary element is, preferably, a portion of the base itself. To permit easy assembly, the base is preferably formed in two parts, with an upper base portion and a floor or bottom base portion. The bottom base portion is formed with a through-bore for each connecting cable. During assembly, the bottom base portion and the upper base portion, after introducing the cable, are interconnected in such a manner that the slit sleeve is introduced into the bore. To ensure proper seating, the smallest outer diameter of the sleeve should be smaller than the largest inner diameter of the bore. By suitable dimensioning, the original circumference of the sleeve is so decreased that the sleeve will engage the insulation jacket of the connecting cable with the desired clamping force to form a strain relief.

DRAWINGS

FIG. 1 is a highly schematic longitudinal sectional view of a lamp with a base and integrated strain relief, in which the lamp and base are not necessarily to the same scale;

FIG. 2*a* is a longitudinal sectional view through one form of sleeve which has an outer conical shape;

FIG. 2*b* is a top view of the sleeve of FIG. 2*a;*

FIG. 3 is a longitudinal sectional view of another embodiment of a sleeve;

FIG. 4*a* is a longitudinal sectional view of yet another embodiment of a sleeve of outer conical shape;

FIG. 4*b* is a top view of the sleeve of FIG. 4*a;*

FIG. 5*a* is a longitudinal sectional view through yet another embodiment of the sleeve having an essentially circular cylindrical outer wall and an axially constricting inner wall;

FIG. 5*b* is a top view of the sleeve of FIG. 5*a;*

FIG. 6*a* is a schematic longitudinal sectional view of a single slit sleeve with an outer conical surface fitted into a base opening having a conical bore in which the cone angle $\alpha$ of the sleeve and the cone angle $\beta$ of the base bottom are identical, so that V=1;

FIG. 6*b* is a view similar to FIG. 6*a*, in which the cone angle $\alpha$ is greater than the cone angle $\beta$, so that V>1;

FIG. 6*c* is a view similar to FIG. 6*a*, in which the cone angle $\alpha$ is less than the cone angle $\beta$, so that V<1;

FIG. 7 is a fragmentary vertical sectional view illustrating, in full-line and broken-line representation, sequential positions of a sleeve with an outer conical surface in a base bottom, in which three positions of the sleeve are shown at A, B and C, respectively;

FIG. 8*a* is a schematic longitudinal sectional view of a connection cable and sleeve, illustrating assembly operations before complete assembly; and FIG. 8*b* is a fragmentary view of a portion of FIG. 8*a* after assembly of the cable in the base bottom.

DETAILED DESCRIPTION

Figure 1:
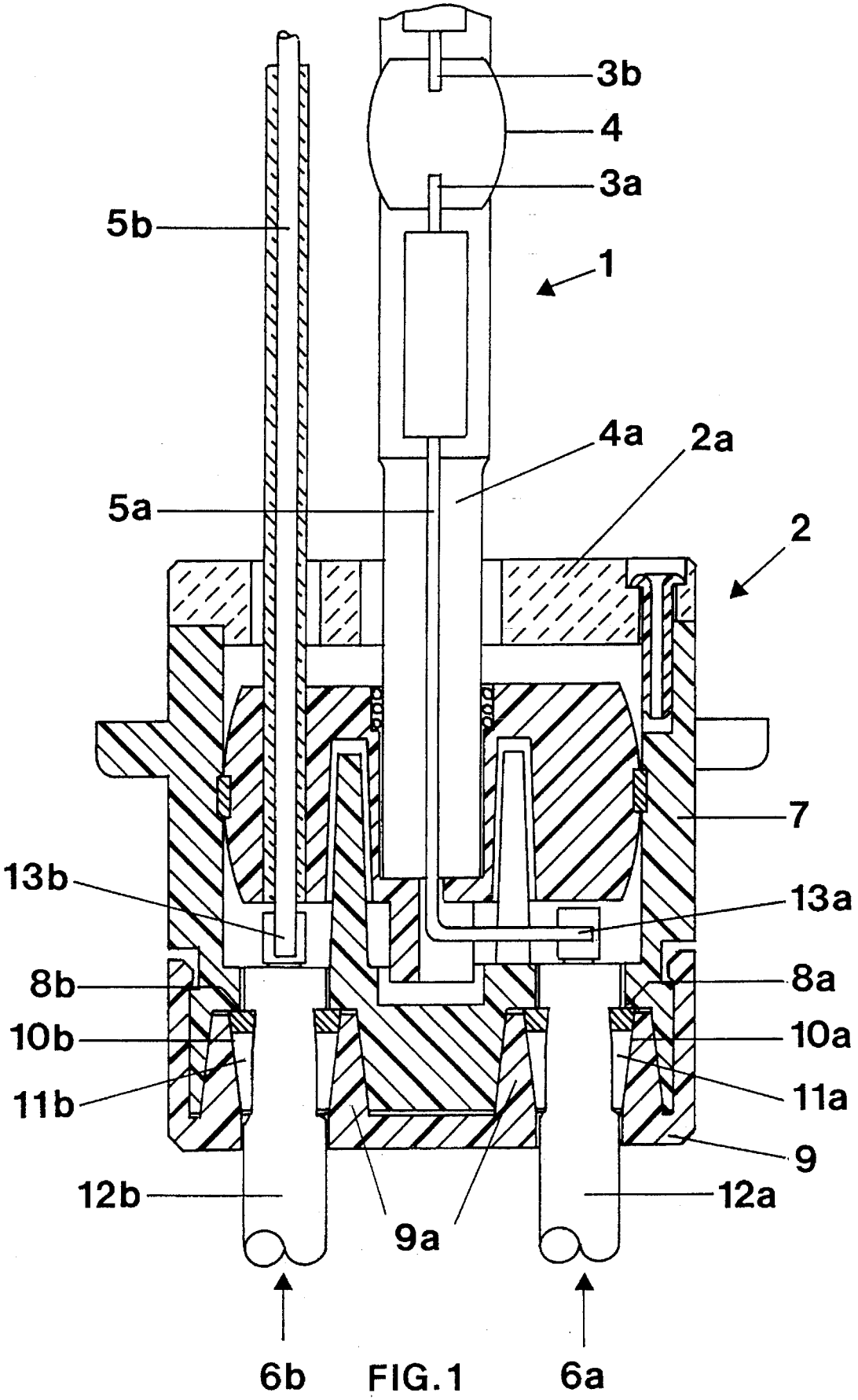

Referring first to FIG. 1 which, highly schematically, illustrates a lamp 1 having an insulating, e.g. plastic or ceramic base 2 with integrated strain relief, in partial, longitudinal section. The lamp shown is specifically suitable for vehicular use and, especially, for automobile headlamps. Two electrodes 3*a*, 3*b* are located within an essentially barrel-shaped discharge vessel 4. One pinch seal, through which electrode 3*a* is connected by a well-known foil connection, is longitudinally extended 4*a* to be retained in the base 2. Base 2, preferably, is of ceramic material. The electrodes 3*a*, 3*b* are connected by current supply leads 5*a*, 5*b* to connecting cables 6*a*, 6*b*. The connecting cables 6*a*, 6*b*, each, have an inner conductor 22 (FIG. 8*a*) surrounded by an outer insulation jacket 12, and as seen in FIG. 1, by insulation jackets 12*a*, 12*b*. The inner conductors have been omitted from FIG. 1 for simplicity of the drawing. The current supply leads 5*a*, 5*b* are connected to the inner conductors; 22 of the cables 6*a*, 6*b* by weld connections 13*a*, 13*b*.

The base 2 has a pot or cup-shaped base portion 7 which is closed off by a disk-like cover 2*a* at the side thereof facing the discharge lamp. At the side remote from the discharge lamp, the portion 7 is formed with two openings for the connecting cables 6*a*, 6*b*. The walls of the openings are formed with two ring-shaped abutments or shoulders 8*a*, 8*b*. A base bottom portion 9 is snapped on the base cup portion 7.

In accordance with a feature of the present invention, the base bottom portion 9 is formed with two conical bores 10*a*, 10*b* which retain two conical sleeves 11*a*, 11*b*. The conical bores are formed in upstanding portions, e.g. projections 9*a*, forming a sleeve retention structure. The sleeves 11*a*, 11*b* have conical outer surfaces. The sleeves surround the connecting cables and secure the connecting cables in position by circumferentially squeezing or clamping the insulation jackets 6*a*, 6*b*. The sleeves engage against the ring-shaped abutments 8*a*, 8*b* with their faces which are directed towards the discharge vessel.

The clamping of the cables prevents longitudinal movement of the connecting cables 6*a*, 6*b*, during assembly, in the direction of the discharge vessel, and outwardly after assembly. This protects the two welds 13*a*, 13*b* with respect to damage and stress being placed thereon.

The insulation jackets 12*a*, 12*b* are uniformly, rotation-symmetrically squeezed or clamped by the sleeves 11*a*, 11*b*.

Figure 2A:
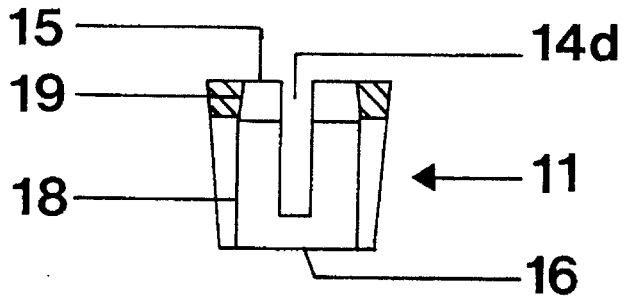
Figure 2B:
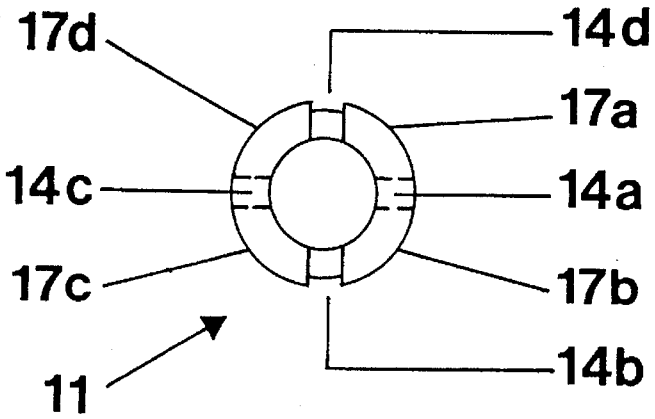

FIGS. 2*a* and 2*b*, taken together, clearly illustrate the function of providing rotation-symmetrical, radially inwardly directed clamping forces on the insulation jackets of the cables 6*a*, 6*b*. The sleeve retention arrangement can be located in a thick bottom formed with the conical bores 10*a*, 10*b* or in upwardly extended projecting extensions 9*a*, 9*b*.

Figure 5A:
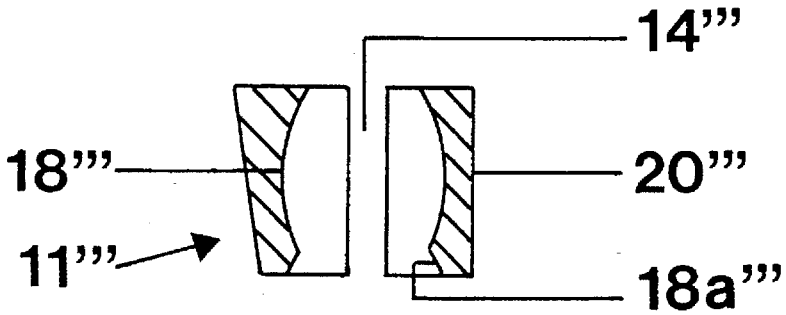
Figure 5B:
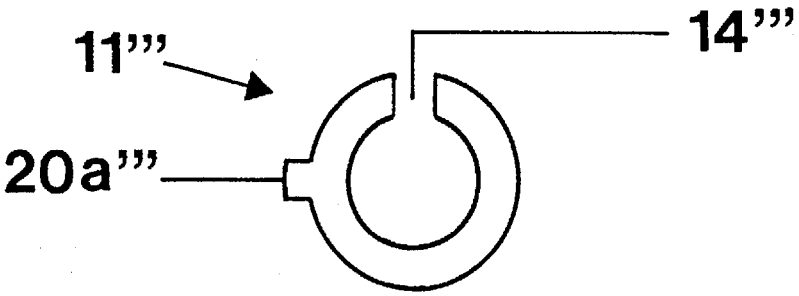

Function and operation, with reference to FIG. 2 (collectively):

The sleeve 11 of FIG. 2 is formed with two counterdirected pairs of slits 14*a*, 14*c* and 14*b*, 14*d*. Diametrically oppositely located slits 14*b* and 14*d* extend from a first end 15 of the sleeve 11 and, relatively rotated 90° with respect thereto, a further pair of slits 14*a*, 14*c* extend from the second end 16. Thus, four movable segments 17*a*, 17*b*, 17*c*, 17*d* are formed. Decrease of the circumference of the sleeve by radially acting forces and the necessary resilient or spring path thus is uniformly circumferentially distributed by the presence of the four slits 14*a*–14*d*. The cylindrical inner wall 18 is formed at the first end 15 with an inwardly projecting ridge or cam-like constriction 19. Thus, when using this sleeve 11 in the structure of FIG. 1, or a sleeve 11''' as shown in FIG. 5 (collectively), the clamping engagement of the sleeve is increased at the location of the inner constriction 19 by engagement in the insulation jacket 12. The respective shaping of the sleeve 11 results in fitting of the sleeve on the insulation jacket without any lateral tilt, twist or misalignment. This embodiment, thus, is particularly preferred when used with automated lamp production.

Figure 3:
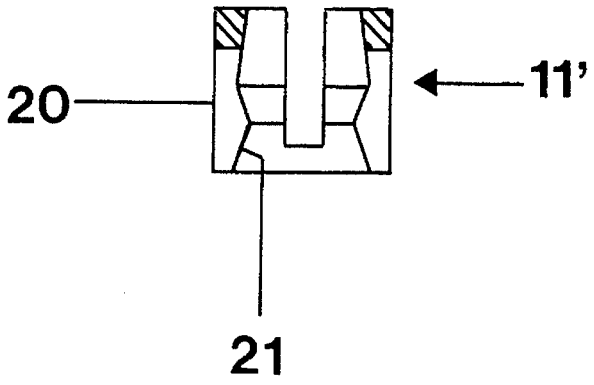

FIG. 3 illustrates another embodiment. A sleeve 11', formed essentially identically to the sleeve of FIG. 2 but differing from the sleeve of FIG. 2, has a straight outer wall but, in the inside, a toothed inwardly projecting structure 21, similar to a shallow sawtooth. The structure 21, forming an inward constriction, engages into the resiliently deflectable insulation jacket 12 and forms an improved interconnecting or interfitting connection between the sleeve 11' and the insulation jacket 12 of the respective cable. This increases the resistance of the cable to tension forces. The constriction 21 must be so dimensioned and matched to the decrease of the diameter of the sleeve and the wall thickness of the insulation jacket 12 that, on the one hand, the desired pull-out strength is ensured and, on the other, the cable and the inner conductor are not damaged. A suitable structure for the constriction 21 is at least one ring-shaped edge, as shown with somewhat triangular—in cross section—tooth-like configuration; similar arrangements in which the inner projection is somewhat rounded are also suitable. The rounding can be slight and is not specifically recognizable in FIG. 3.

Figure 4A:
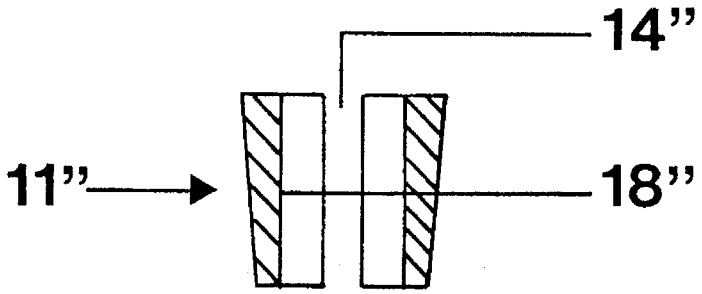
Figure 4B:
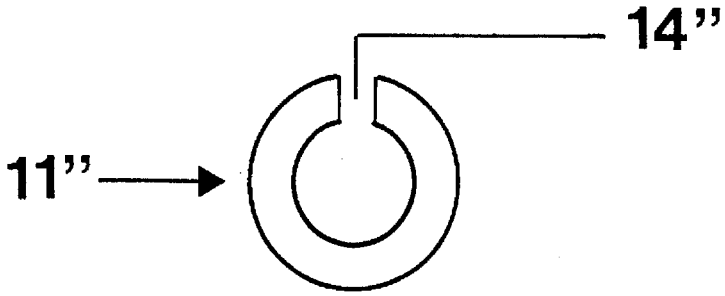

FIG. 4, collectively, illustrates a sleeve 11" which has an outer conical wall and one longitudinal through-slit 14". The inner wall 18" is cylindrical. The single slit sleeve 11" is suitable to decrease the circumference of the sleeve over a distance which is essentially uniform over the entire length of the sleeve 11". This is the simplest form of the sleeve, and also the least expensive to manufacture.

FIG. 5, collectively, illustrates another embodiment; a sleeve 11''' has one through-slit 14'''. The inner wall 18''' has an essentially concave, rotation-symmetrical surface. An outer chamfer 18*a*''' facilitates fitting the sleeve on a cable 6. The outer wall 20''' is, essentially, circular cylindrical and is formed with an inclined ramp-like or wedge-like projection 20*a*''', extending axially along the sleeve 11''' at an inclination. This projection 20*a*''' has the effect and function of compressing the sleeve, similar to a conical outer wall.

Basically, the dimensions of the inner diameter or the profile or shape of the sleeve should be so designed that the sleeve can be easily fitted over the insulation jacket of the connecting cable during assembly, and squeezing or pinching of the insulation jacket or, respectively, penetration of an element of the sleeve into the insulation jacket, ensures that the desired strain relief is obtained, without however damaging the inner conductor. Especially, any edges of the resulting structure, for example the inwardly projecting edge 21, can be rounded. Preferably, the minimum inner diameter of the sleeve, before assembly, should be between 0.1 and 1 mm, or even more than the outer diameter of the connecting cable 6.

The axial slits 14, 14' . . . provide for reduction of the diameter of the sleeve before being fitted into the strain relief arrangement portion of the base. The axial slits ensure that forces will be applied against the cable with an essentially inwardly radial direction. The width, length and number of the slits, as well as the springy or resilient effect of the materials used, can be relatively selected to ensure maximum possible decrease of the diameter of the sleeve. The material of the sleeve, of course, should be harder than the material of the insulation jacket of the cable. Suitable materials are plastics having appropriate characteristics for the purpose, and many plastic materials are usable.

The arrangement illustrated in connection with FIG. 2 (collectively) is particularly suitable since the counterdirected slits, especially when symmetrically distributed, provide for excellent reduction of the effective diameter of the sleeve and radial application of forces. This arrangement permits high, and still effectively uniform reduction of the diameter.

The number of the oppositely directed pairs of slits can be suitably selected. As the number of the pairs of slits increases, an ideal rotation-symmetrical reduction in circumference will result, at the cost, however, of higher manufacturing expenses.

Reduction of the circumference of the slit sleeve is obtained this way: during assembly, that is, while connecting the bottom 9 to the cup-shaped upper portion 7 of the base, axial forces are transformed at least in part into radially inwardly directed forces. This is obtained by forming either the outer wall of the sleeve or the inner wall of the bore 8, or both, at least in part in cone or wedge form. The cone angles of the sleeve and the bore do not necessarily have to be the same. The outer wall of the sleeve, and/or the inner wall of the bore, can also be circular cylindrical. If both walls are essentially circular cylindrical, one of the walls should be formed with either a projecting portion 20*a*''' or a receding portion which is ramp or wedge-like and which, from a projecting region, decreases gradually in axial direction. Prior to introduction of the sleeve into the bore, the minimum original, uncompressed outer diameter of the sleeve should be smaller than the largest inner diameter of the bore.

Figure 6A:
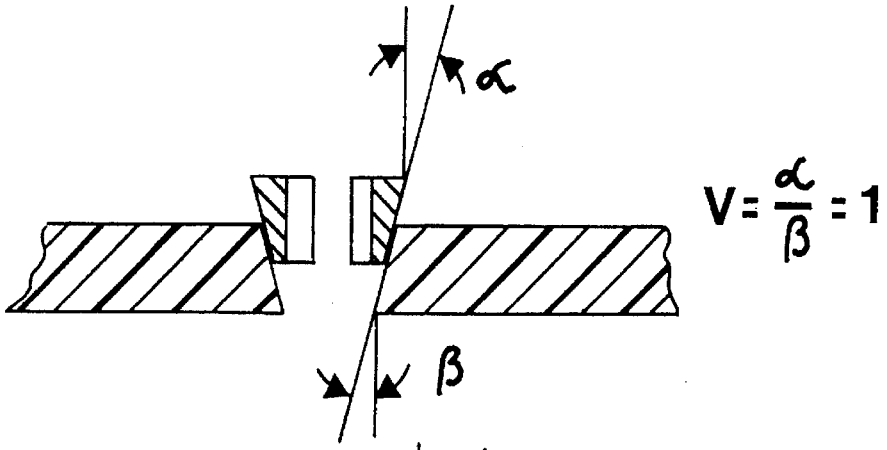
Figure 6B:
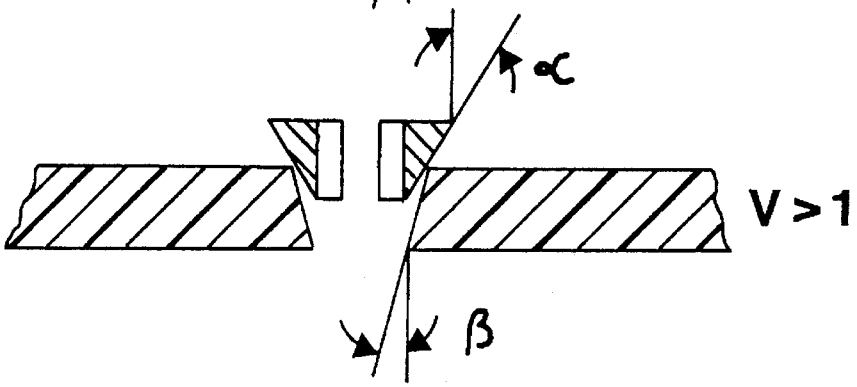
Figure 6C:
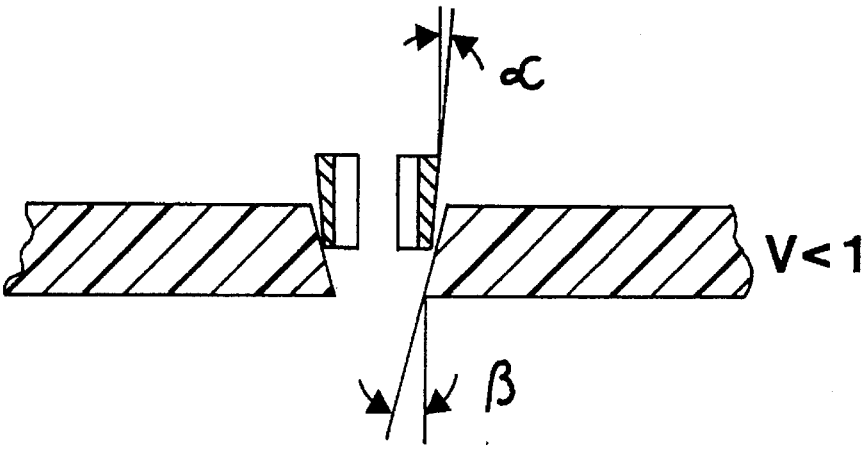
Figure 7:
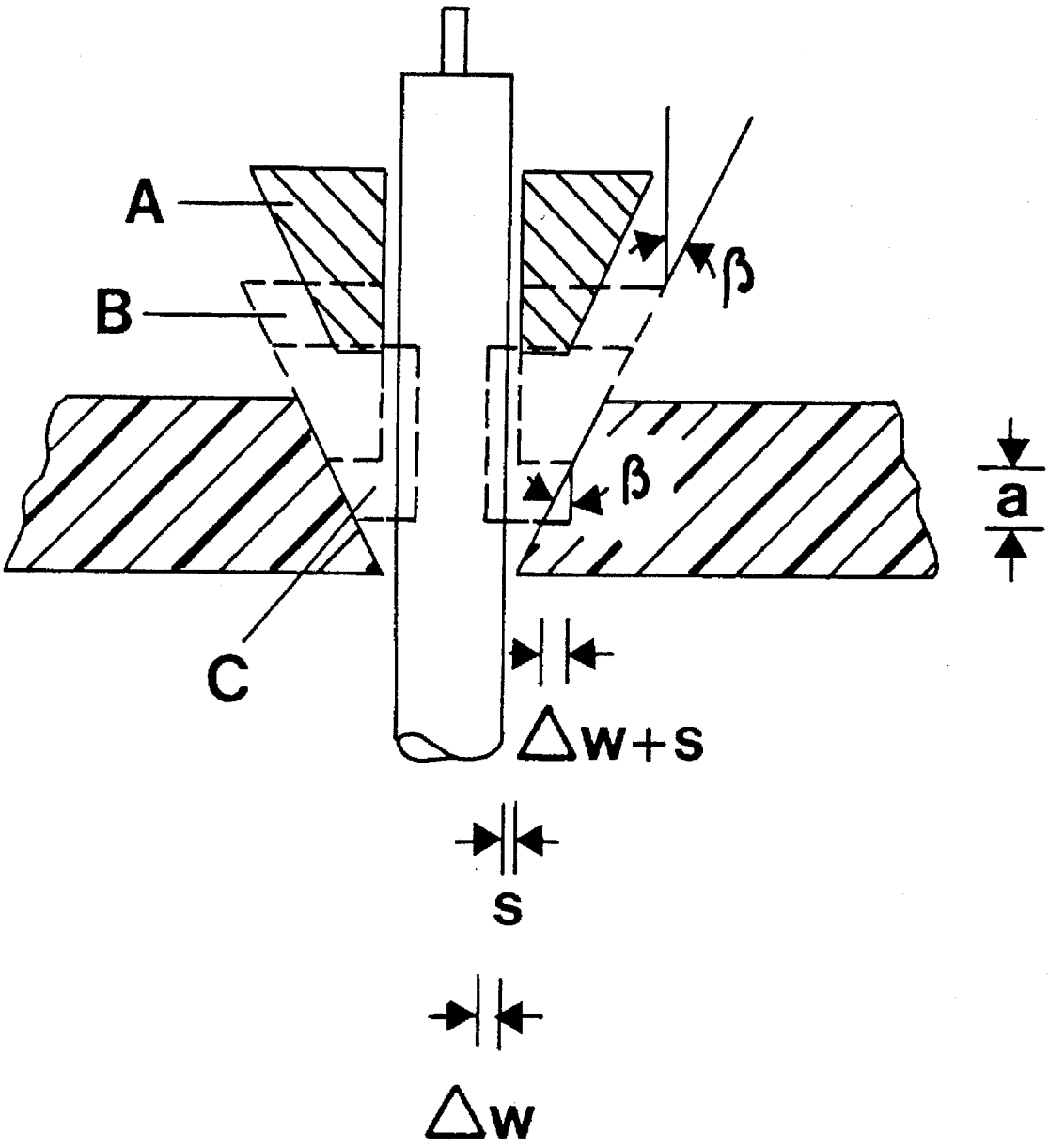

Referring now to FIGS. 6 and 7, collectively: The relationship V of the angles $\alpha$ and $\beta$, with respect to the longitudinal axis of the connecting cable, permits control of the distribution of the forces which act radially on the sleeve with respect to the longitudinal direction of the sleeve. The angle $\alpha$ is the cone angle of the sleeve; the angle $\beta$ is the cone angle of the opening in the bottom 9 or in a projection 9*a* (FIG. 1). Three different relationships of $V=\alpha/\beta=1$, $V>1$ and $V<1$ are shown, with a single slit outer conical sleeve having circular cylindrical inner walls. The angle $\beta$ remains the same in all three illustrations. The same example could be given with a single constant angle $\alpha$, and varying the angle $\beta$ or, respectively, varying both angles $\alpha$ and $\beta$. If the cone angles are equal, that is, $V=1$, the sleeve is uniformly radially compressed over its entire outer surface, so that axially along the sleeve there is uniform decrease of the inner diameter. For $V>1$, FIG. 6*b*, the diameter decreases more at the side of the bore which is remote from the bottom wall than at the side of the opposite end of the bore, that is, close to the bottom surface of the bottom 9. As a result, the sleeve will compress at the first or upper end thereof. For $V<1$, see FIG. 6*c*, the relationships are opposite. Depending on the absolute value of $V\neq1$ (V is not. 1), a particularly strong deformation of the insulation jacket will be obtained at a location close to one or the other end of the sleeve.

During assembly, reduction in the circumference U will occur only when the outer wall of the sleeve engages the inner wall of the bore 8*a*, 8*b*. As the sleeve is moved further in axial direction by a distance a (FIG. 7), a reduction to $\Delta U$ is obtained. FIG. 7 illustrates the example with respect to a sleeve-bore combination as illustrated in FIG. 6*a*, that is, $V=1$. Three positions upon introduction of the sleeve into the bore are shown.

In a first position, at a state A, the sleeve is pushed on the cable, but does not yet have a contact with the bore. In state B, the sleeve touches and engages the bore, but still has the original circumference. In state C, the sleeve has been shifted by the path a in axial direction, so that the inner wall of the sleeve digs into the insulation jacket by the distance $$\Delta w=\alpha\cdot\tan\beta-s\ldots \quad (1)$$

In the above, s defines the ring gap between the inner wall of the sleeve and the insulation jacket. The reduction $\Delta U$ of the inner wall of the sleeve, that is, the difference between the original circumference $U_o$ and the circumference after assembly, that is $U(\alpha, \beta)$, can be mathematically determined as $$\Delta U=U_o-U(\alpha, \beta)=2\pi\cdot(\Delta w+s)=2\pi\cdot\alpha\cdot\tan\beta\ldots \quad (2)$$

In case $V>1$, the arrangement prevents that, during assembly of the base bottom 9, the sleeve can slip on the insulation jacket of the connecting cable. Since, in this embodiment, the end of the sleeve facing the upper base portion decreases in diameter and, thereby, engages into the insulation jacket, movement of the sleeve along the insulation jacket is already prevented before assembly, that is, even before the base bottom and upper portion has reached its final position and the sleeve is decreased and constricted to its final diameter. This also increases the strength of the strain relief since, upon tension stresses applied on the cable, the end of the sleeve which is remote from the bottom of the base digs into the insulation jacket counter the direction of applied tension.

To prevent slipping in the case of V=1, the upper portion of a connecting bore in the base is formed with the abutments or shoulders 8*a*, 8*b*, preferably in ring shape. The upper part of the base has the separate connecting bore, with the diameter only of the cable, extending towards the welding portion 13*a*, 13*b*. Only the cable, but not the sleeve, will fit through that part of the bore. After the sleeve is pushed up to the abutment 8*a*, 8*b* over the insulation jacket, and the bottom 9 is only then pushed over the cable and ultimately snapped into the upper base portion 7, the sleeve will engage the insulation jacket and apply radial squeezing or clamping forces, without permitting the sleeve to move or escape in axial direction during assembly. This effectively prevents movement of the cable, and thus any possible damage to the welds 13*a*, 13*b* between the inner conductor 22 of the respective cable and the current supply leads 5*a*, 5*b*.

Figure 8A:
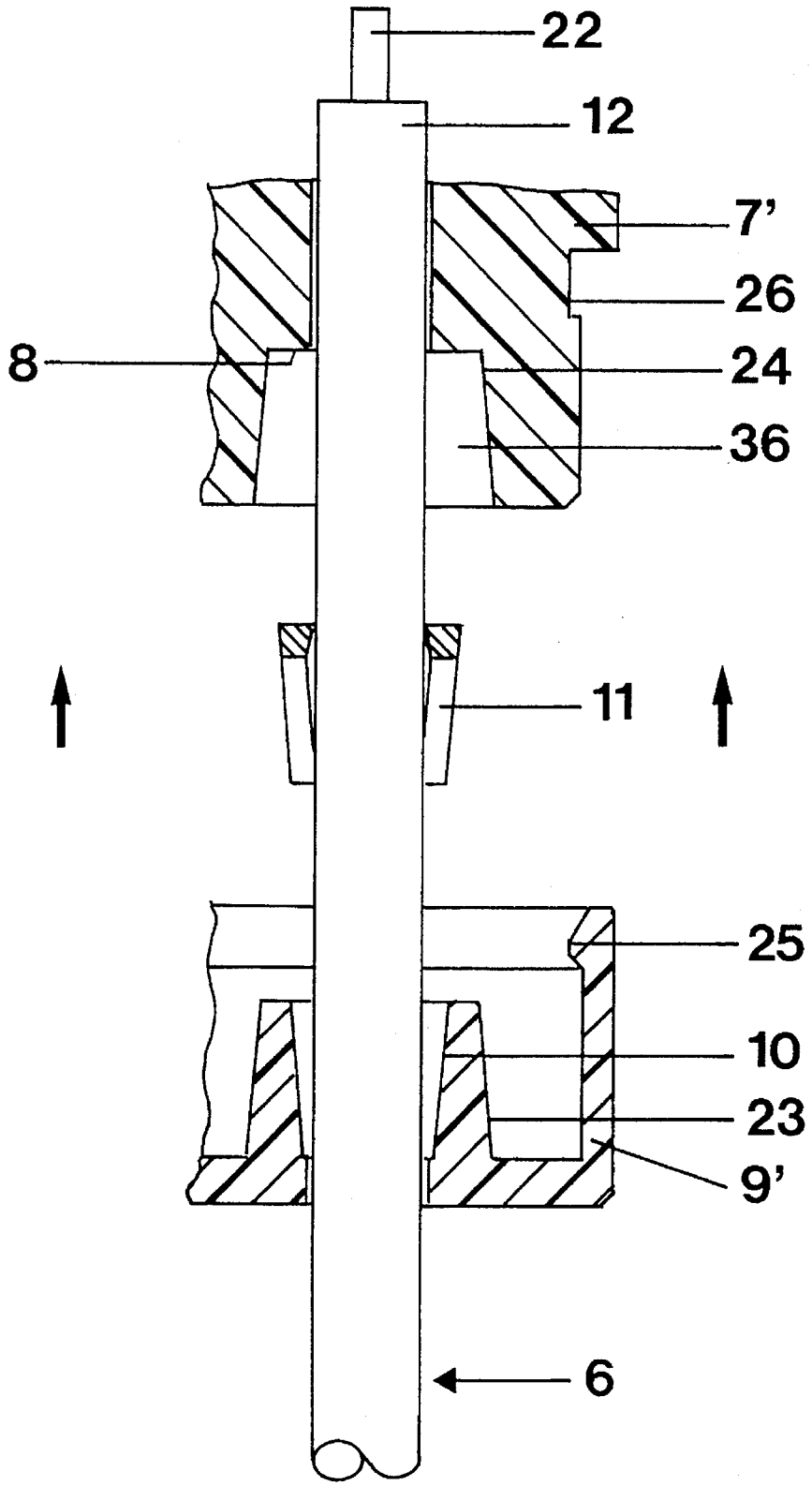

FIG. 8*a* illustrates the sequence of assembly in detail. The connecting cable 6, with the inner conductor 22 and the insulation jacket 12, are shown, together with the strain relief arrangement, the base portion 7', the outer conical sleeve 11 of FIGS. 2*a*, 2*b*, and the base bottom 9'. The base bottom 9', the outer conical sleeve 11, and the base portion 7' are fitted, in this sequence, on the blank, stripped end of the connecting cable 6. The base bottom 9' is pushed in the direction of the arrow, that is, in the direction of the base portion 7', and carries the sleeve 11 along until it engages the abutment 8. The conical bore 10 is then moved further upwardly in the direction of the arrow, which squeezes the sleeve 11 together until the outer inclined surface 23 of the projection 9*a* of the base bottom 9' seats in the inner inclined surface 24 of the base portion 7'. The inner projection 25 from the base bottom 9' can then snap into the groove 26 of the base portion 7', holding the bottom or base bottom 9' in position. The inclination of the outer wall of the sleeve 11 has approximately the same cone angle as the bore 10, that, is V=1 (FIG. 6*a*).

Figure 8B:
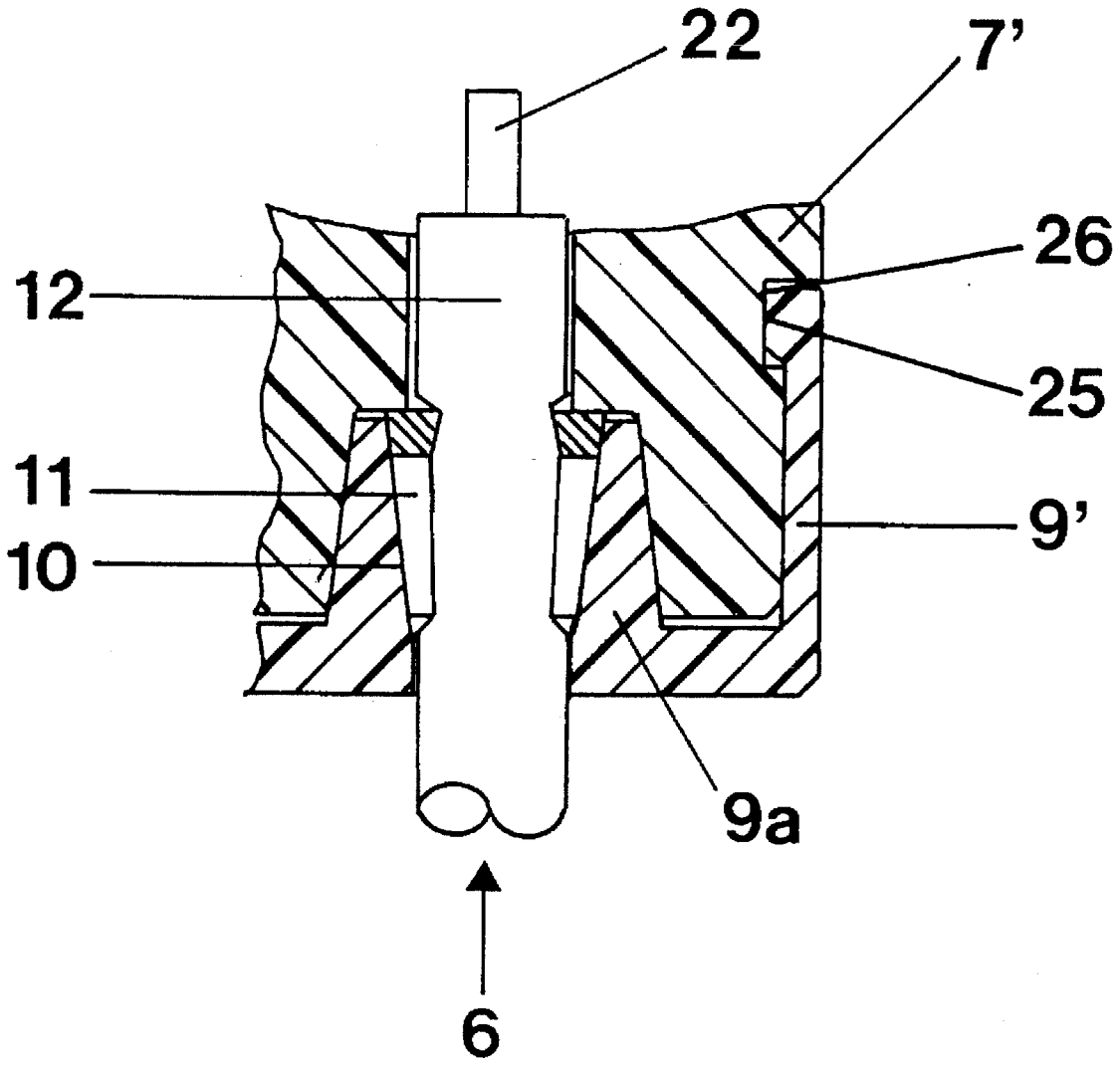

FIG. 8*b* illustrates the above elements when assembled together, in which the conical bore 10, and the particular arrangement of the slits, results in uniform decrease of the original diameter of the sleeve 11. The inclined position of the inner wall of the sleeve 11 is maintained, so that it elastically deforms the insulation jacket 12 of the cable 6, as desired. FIG. 8*b* clearly shows the rotation-symmetrical interengagement between the inner wall of the sleeve 11 and the insulation jacket 12 of the connecting cable 6, resulting in the high strain relief. The rotation-symmetrical squeeze on the insulation jacket also forms an essentially liquid and moisture-tight seal.

In similar manner, a sleeve with a straight outer wall (FIG. 3) can be secured in the slightly conically formed bore of the bottom of the base, in which the engagement force is not axially essentially uniformly distributed, but rather concentrated to the narrowest diameter of the bore.

The lamp can be any suitable lamp, for example a discharge lamp, an incandescent lamp, operating with or without a halogen cycle or the like.

Various changes and modifications may be made, and any features disclosed herein can be used with any of the others, within the scope of the inventive concept.

We claim:

1. A single-based electric lamp comprising a lamp bulb (4) having a light-emitting means (3*a*, 3*b*) therein;

a base (2) having a top portion (7) retaining said bulb (4), and a bottom portion (9, 9');

Two current supply leads (5*a*, 5*b*) extending from said bulb for supply of electrical energy to the light-emitting means therein;

at least one connection cable (6*a*, 6*b*) extending into the base (2), through the bottom portion (9, 9') and electrically connected to one of the current supply leads, said at least one connection cable having an inner conductor (22) and a deformable insulation cover (12, 12*a*, 12*b*) surrounding the inner conductor; and a strain relief arrangement for the at least one electrical cable (6*a*, 6*b*) integrated into the base, wherein the strain relief arrangement comprises at least one resilient sleeve (11*a*, 11*b*) having an inner wall (18) surrounding the at least one connection cable (6*a*, 6*b*) and a sleeve reception structure (9*a*) located inwardly of the bottom portion (9, 9', 10) of the base, formed with a sleeve reception bore (10*a*, 10*b*) receiving and surrounding the at least one resilient sleeve (11*a*, 11*b*) and exerting essentially uniformly circumferentially distributed, radially inwardly directed forces on said resilient sleeve, thereby essentially circumferentially uniformly decreasing the diameter of the resilient sleeve, the inner wall (18) of the resilient sleeve clampingly engaging and squeezing the deformable insulation cover (12, 12*a*, 12*b*) of the at least one connection cable (6*a*, 6*b*) and, optionally, interengaging with the deformable insulation cover; and wherein the bottom portion (9, 9') of the base (2) and the top portion (7) of the base are coupled together.

2. The lamp of claim 1, wherein said sleeve reception structure (9*a*) is an integral part of the bottom portion (9, 9').

3. The lamp of claim 1, wherein the diameter of the resilient sleeve, before exertion of radially inwardly directed forces thereon, is smaller than the largest inner diameter of the sleeve reception bore (10*a*, 10*b*) to permit ready insertion of the at least one sleeve in a respective bore.

4. The lamp of claim 3, wherein the outer wall surface of the sleeve (11*a*, 11*b*) is, at least in part, conical.

5. The lamp of claim 3, wherein the outer wall of the sleeve is essentially circular cylindrical and is formed with an axially extending projection (20*a*''') which tapers axially at least over a portion of the axial length of the sleeve.

6. The lamp of claim 3, wherein the inner wall of the sleeve reception bore (10*a*, 10*b*) is, at least in part, of conical shape.

7. The lamp of claim 3, wherein at least one of: the inner wall of the bore (10*a*, 10*b*) and the outer wall of the sleeve (11*a*, 11*b*) is formed with a laterally, axially extending projection (20*a*''') which extends, at least in part, axially from the at least one bore or sleeve.

8. The lamp of claim 3, wherein the sleeve (11*a*, 11*b*) has an inner wall (18) which is shaped for squeezing and interengaging coupling with the deformable insulation cover of the at least one connection cable.

9. The lamp of claim 8, wherein the inner wall (18) comprises an essentially circular cylindrical surface which, at least at one end (15) of the sleeve is formed with a constriction (19).

10. The lamp of claim 8, wherein the inner wall (18) is shaped to form a concave surface.

11. The lamp of claim 8, wherein the inner wall (18) is formed with an inwardly projecting, sawtooth-like shape extending rotation-symmetrically around the inner wall.

12. The lamp of claim 8, wherein the inner wall is formed with an inwardly extending essentially circumferential projection which is rounded at its innermost region.

13. The lamp of claim 1, wherein the sleeve is formed with at least one slit (14) extending essentially parallel to the axis of the sleeve.

14. The lamp of claim 13, wherein the sleeve (11", 11"') has a single through-slit (14", 14"').

15. The lamp of claim 13, wherein at least two slits (14) are provided, extending from opposite ends of the sleeve over a portion of the axial length of the sleeve.

16. The lamp of claim 15, wherein at least two pairs of slits (14*a*–14*d*) are provided, in which the slits of any pair are located diametrically opposite from each other, the slits of respective pairs extend from different ends of the sleeve, and the different pairs are offset by 90° from each other, to define four movable sleeve segments.

17. The lamp of claim 1, wherein the top portion (7) of the base is formed with at least one through-bore having an inner diameter matched to and closely receiving the insulation cover of the at least one cable;

and wherein said at least one bore terminates in a wider portion defining an abutment shoulder (8*a*, 8*b*) to form an abutment stop for the sleeve.

18. The lamp of claim 1, wherein the top portion (7) is formed with at least one widened blind bore (36) dimensioned and shaped to receive said strain relief arrangement; and wherein the blind bore defines, at its end, an abutment surface (8) to form an abutment stop for the at least one sleeve (11).

19. The lamp of claim 1, wherein at least one of: the outer wall of the sleeve (11) and the inner wall of the sleeve reception bore (10) has conical shape.

20. The lamp of claim 19, wherein the cone angle of the sleeve (11) with the longitudinal axis of the sleeve is greater than the cone angle of the inner wall of the bore (10) with the longitudinal axis of the bore (10), whereby the diameter and hence the circumference of the sleeve is constricted to a greater extent at the end of the sleeve facing the lamp bulb (4) than at the opposite end of the sleeve.

21. The lamp of claim 19, wherein the cone angle of the sleeve (11) with the longitudinal axis of the sleeve is less than the cone angle of the inner wall of the bore (10) with the longitudinal axis of the bore (10), whereby the diameter and hence the circumference of the sleeve is constricted to a greater extent at the end of the sleeve which is remote from the lamp bulb (4) than at the opposite end of the sleeve.

22. The lamp of claim 19, wherein the cone angle of the sleeve (11) with the longitudinal axis of the sleeve (11) is the same as the cone angle of the inner wall of the bore (10) with the longitudinal axis of the bore (10), whereby the diameter and hence the circumference of the sleeve is constricted axially uniformly and the sleeve is decreased in diameter, and hence circumference, along the length of the sleeve by the same amount.

* * * * *